US006135661A

United States Patent [19]

Houser

[11] Patent Number: 6,135,661

[45] Date of Patent: Oct. 24, 2000

[54] WRITING IMPLEMENT

[76] Inventor: Roy W. Houser, 3420 Via Loma Vista, Escondido, Calif. 92029

[21] Appl. No.: 09/514,498

[22] Filed: Feb. 29, 2000

[51] Int. Cl.[7] ..... B43K 29/00

[52] U.S. Cl. ..... 401/195; 401/52

[58] Field of Search ..... 401/195, 52, 99, 401/109, 111, 192, 209

[56] References Cited

U.S. PATENT DOCUMENTS

| | | | |
|---|---|---|---|
| D. 329,459 | 9/1992 | Sullivan | D19/36 |
| 2,005,110 | 6/1935 | Ritzert | 281/5 |
| 2,073,719 | 3/1937 | Ross | 242/55.2 |
| 2,111,362 | 3/1938 | Fisher | 40/108 |
| 2,224,470 | 12/1940 | Boust | 242/55.2 |
| 2,287,618 | 6/1942 | Josephs | 401/52 |
| 2,512,168 | 6/1950 | Moore | 206/59 |
| 2,517,445 | 8/1950 | Ruhland | 206/37 |
| 2,601,650 | 6/1952 | Walter et al. | 242/55.5 |
| 3,963,358 | 6/1976 | Houser | 401/195 |
| 4,030,842 | 6/1977 | White et al. | 401/195 |
| 4,872,775 | 10/1989 | Chang | 401/52 |
| 4,963,048 | 10/1990 | Thomas et al. | 401/52 |
| 5,158,384 | 10/1992 | Radmilovic et al. | 401/195 |
| 6,039,492 | 3/2000 | Chen | 401/195 |

*Primary Examiner*—David J. Walczak
*Attorney, Agent, or Firm*—Frank G. Morkunas

[57] ABSTRACT

A writing implement having an elongated body with a chamber inside; a removable end member on the body; an elongated rod-like removable inscribing member within the body; and, on the body, a door with a hinge edge movably attached to the body and an opening edge opposite the hinge edge which, when the door is opened, exposes the chamber inside the body and also exposes an outer edge on the body which, when the door is closed, this outer edge is adjacent to and aligned with the opening edge. The writing implement also has a removable (and thereby, replenishable) roll of paper housable in the chamber and rollably held there by the inscribing member such that as paper is needed, the door is opened, the paper is unrolled to a desired length, the door is closed, and the paper so removed from the chamber is torn at the opening edge. Serrations on the opening edge and the outer edge facilitate the tearing.

13 Claims, 1 Drawing Sheet

WRITING IMPLEMENT

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

This present invention relates to an improvement in writing implements, and more particularly to pens and pencils having a removable or replaceable refill-like inscribing member by providing an easy-access to the inner chamber of such implements and by further providing an easily insertable, easily removable, and easily useable paper source upon which to write.

Patents exist which have incorporated writing paper and information paper into pens and into mechanical pencils. Several such patents include U.S. Pat. No. 2,005,110 issued to Ritzert; U.S. Pat. No. 2,073,719 issued to Ross; U.S. Pat. No. 2,111,362 issued to Fisher; U.S. Pat. No. 2,224,470 issued to Boust; U.S. Pat. No. 2,512,168 issued to Moore; U.S. Pat. No. 2,517,445 issued to Ruhland; U.S. Pat. No. 2,601,650 issued to Walter; U.S. Pat. No. 3,963,358 issued to me (Houser); U.S. Pat. No. 4,030,842 issued to White; U.S. Pat. No. 4,872,775 issued to Chang; and U.S. Pat. No. 5,158,384 issued to Radmilovic. These writing implements all have the added functionality of dispensing writing paper or informational paper for the user and are well-suited for the intended purposes. The problem, however, with each is that each is complex in structural design, difficult to refill with paper, and because of their complexity, have a tendency to jam in use, before use, or after use.

The present invention is novel in its simplicity. From this simplicity comes the unique structural features with its concomitant ease of use, ease of refilling with paper, ease of storing, ease of maintenance, and ease of manufacture. There are no spring-loads to contend with, retraction elements, or separate housing for the paper. The door on the body exposes the paper within. Removal of an end cap permits easy removal of the refill element (inscribing member of the pen [ink refill] or pencil [lead refill] as the case may be), insertion of a new roll of paper through the door entrance into the body chamber of the writing implement, replacement of the refill element, and recapping of the end cap. No special tools are required nor is any special dexterity required. These features of the present invention far surpass the complexities of the prior art writing implements thereby making the present invention much more user-friendly and less costly to produce and purchase.

Accordingly, several objects and advantages of my invention are to:

a. provide a writing implement which also provides the user thereof with writing paper;

b. provide easy access to the inner chamber of the writing implement;

c. provide ready access of writing paper for a user;

d. eliminate the complexities of a writing implement which fosters jamming;

e. accommodate ease of manufacture of a writing implement bearing the features of the present invention;

f. produce a writing implement bearing the features of the present invention which is relatively inexpensive to manufacture; and g. provide to end-users a writing implement bearing the features of the present invention at a relatively low cost.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a writing implement having an elongated body with a chamber therein; a removable end member on the body; an elongated rod-like removable inscribing member within the body; and, on the body, a door with a hinge edge movably attached to the body and an opening edge opposite the hinge edge which, when the door is opened, exposes the chamber within the body and further exposes an outer edge on the body which, when the door is closed, this outer edge is adjacent to and aligned with the opening edge. The writing implement further has a removable roll of paper housable in the chamber and rollably held in place thereat by the inscribing member whereby as paper is needed, the door is opened, the paper is unrolled in a desired quantity, the door is closed, and the paper so removed from the chamber now being tearable at the opening edge. Serrations on the opening edge and the outer edge facilitate the tearing.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
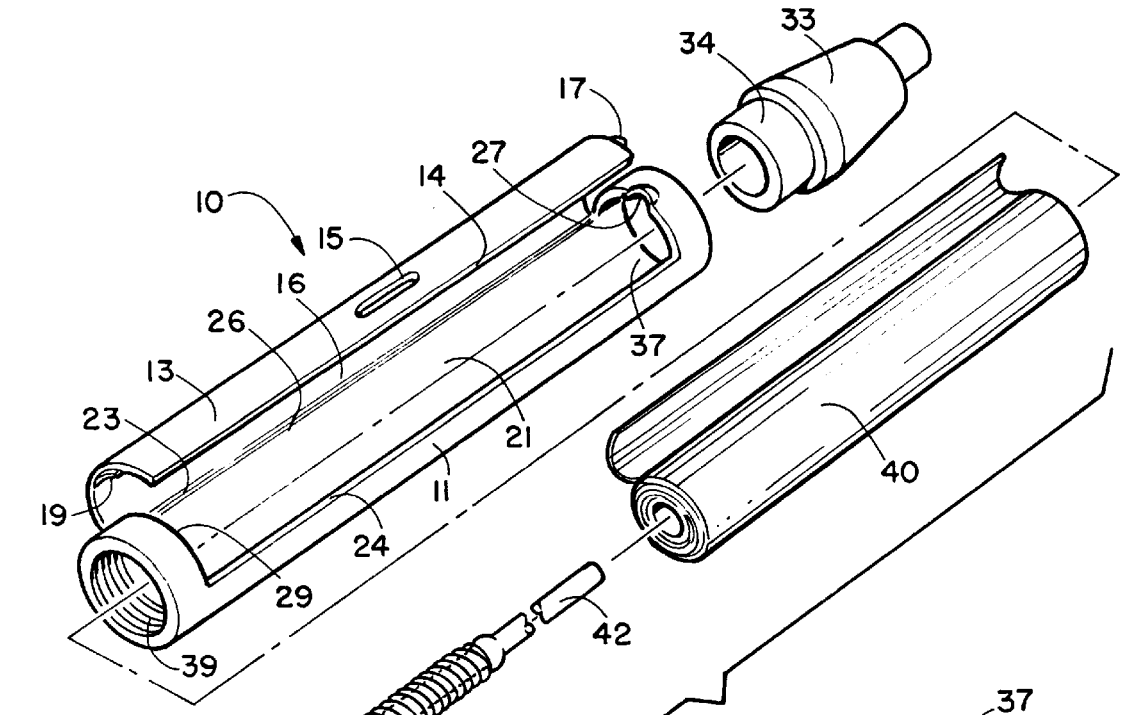
FIG. 1 is an exploded perspective view of the writing implement.

Referring now to the drawings in detail and in particular to FIG. 1, reference character 10 generally designates a writing implement, such as a pen or mechanical pencil having refillable writing or inscribing members 42, constructed in accordance with a preferred embodiment of the present invention. The writing implement has a body 11 with a first section 37 at one end (here for illustration purposes only, and not by way of limitation, is shown as the top) and a second section 39 at the other end (here for illustration purposes only, and not by way of limitation, is shown as the bottom). The bottom end 31, or writing end, is connected to the bottom section 39 and the top end 33 is connected to the top section 37. As with most pens and mechanical pencils, the top end 33 generally is the retracting mechanism for the writing implement. A retracting mechanism is not necessarily required for this writing implement; but, if so constructed, any conventional retracting mechanism will suffice.

Either or both of such ends (top 33 or bottom 31) may be removable from the body 11 and as such each may also be referred to as an end member or end cap. In this regard, either or both ends may be friction-fitted (as illustrated by fitting 34) or may be threadable (as illustrated by threading 32) onto the body 11. To accommodate a variety of refill types 42 and paper rolls 40, the body 11 of the writing implement 10 may be short or elongated or any size between.

The body 11 has an openable door 13 thereon. This door 13 may be a small width door of less than 90° or may exceed 180°. However, for practicalities of use and manufacture, I have found that about 180°, give or take 45°, is best suited for the intended purpose and structural integrity. The door 13 is joined to the body 11 at the hinge edge 26 forming the hinge 23 and the door 13 may swivel freely thereon from open to shut positions. When shut, it encases the body 11. When open, it exposes a chamber 21 within the body 11. The chamber 21 houses the inscribing member 42 and the paper roll 40.

When the door 13 is in the open position, it also exposes the opening edge 14 of the door and the outer edge 24 of the body. With the writing implement 10 in this exploded condition it is set for re-fitting and operation. Recall, that either top or bottom end (or both) is/are removable by either friction-fit or threading and the discussion which follows is not meant to be limiting to either particular end section but applies to the other as well or to both simultaneously. In this case, assume the bottom end 31 to be non-removable. A user would open the door 13, insert the paper roll 42 into the exposed chamber 21, insert the inscribing member 42 through the top of the body 11 and through the paper roll 40 therein, recap the top of the body 11 with the top end section 33, and close the door 13. The writing implement 10 looks in appearance like any other writing implement and, more importantly, it functions like any other writing implement.

Figure 2:
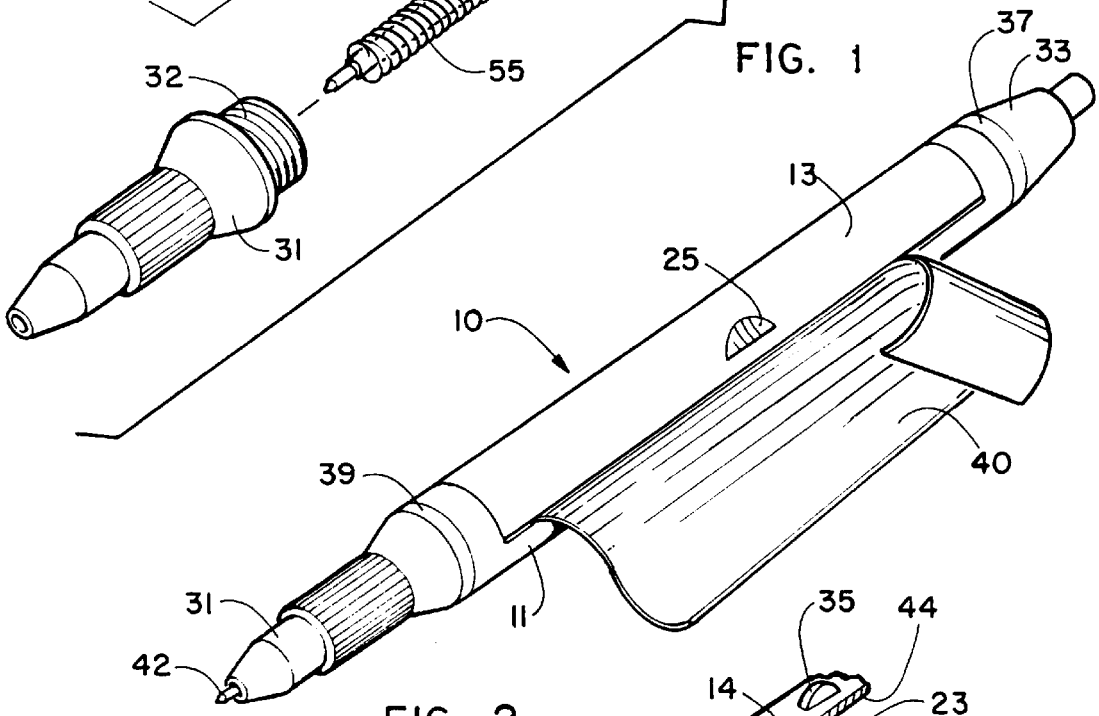
FIG. 2 perspective view of the writing implement with the paper from therein exposed and torn.

When a user is in need of paper, the user simply opens the door 13 exposing the paper 40 within the chamber 21 of the body 11. The loose end of the paper is grabbed and rolled out to the desired length. The door 13 is then closed. The rolled out paper is exposed outside the body 11 of the writing implement 10. The exposed paper is grasped, the door 13 and body 11 held firmly, and the paper is torn from the writing implement 10. This is illustrated in FIG. 2. Tearing is facilitated because of the relative configuration of the opening edge 14 of the door 13 and the outer edge 24 of the body 11. When the door 13 is in a closed position, these two edges abut one another and 'pinch' the paper contained between the two edges. With the door 13 and body 11 held fast, the paper does not move and is easily torn from the outside in an alignment with the two edges.

To re-fill the chamber with paper when all paper is fully expended, the procedure is the opposite of that described above. First the top 33 is removed, followed by the removal of the inscribing member 42, the door 13 is opened, a new roll of paper 40 is placed into the chamber 21, the inscribing member 42 re-inserted into the body 11, and the top 33 replaced and the door 13 is closed. It must be understood that, in the examples described above, the door 13 may be opened or closed at any time during the process and these examples are not meant to be limitations.

One can quickly come to appreciate the simplicity of the structural design of this writing implement and its ease of use. Replacing the inscribing member 42 is not affected. The addition and replacement of writing paper is made simple. The possibility of jamming is eliminated. There are no complex mechanisms, no springs, no retraction gears, no separate paper cartridges, no paper reels, and the like. An added feature from the elimination of these structurally complex parts results in the addition of chamber space to accommodate a greater supply of paper on the paper roll. In other words, less is more. The writing implement with paper is more user-friendly, more trouble-free, and more versatile.

Figure 3:
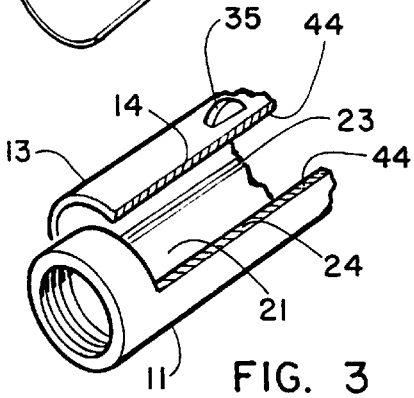
FIG. 3 is a detailed partial view of the body of the writing implement and its adjacent door panel.

FIG. 3 illustrates the incorporation of serrations 44 to assist in tearing the paper. Serrations may be on either the opening edge 14 of the door or on the outer edge 24 of the body 11 or on both edges. If on both edges, the saw-teeth of the serrations of one edge should mate with the opposing valleys on the other edge.

To facilitate the opening of the door 13 I have fashioned a slot 15 (refer to FIG. 1). A user may insert a fingernail or other implement (such as a coin, a screwdriver, a paper clip, and the like) into the slot 15 and pry the door 13 open. In FIG. 2, I have fashioned an indent 25 or impression on the door 13, into which a user may place the user's finger or other implement as described above and pry open the door 13. Similarly, the door also may be constructed with a protrusion or tab-like structure 35 thereon to facilitate its opening as shown in FIG. 3.

To retain the door 13 in a closed position, detents 17, 19 or detent-like structures or other biased members are on the door 13 with corresponding receptacles 27, 29 or receivers on the body 11. It must be understood that the detents 17, 19 (or detent-like structures or other biased members) may also be on the body 11 with the corresponding receptacles 27, 29 or receivers on the door 13.

This writing implement 10 may be made of any material suited for the intended purpose. The most widely used conventional materials are polymers and/or metals or composites. I have found that molding the body 11 and door 13 from high density polypropylene plastic is best as a thin membrane may be formed during this process as the hinge edge 26 or hinge 23 which connects the door 13 to the body 11. This provides for a versatile, long-lasting hinge 23.

It should be understood that access to the chamber 21, whether to remove or replenish the paper 40, may be made from removal of the top end 33, removal of the bottom end 31, or opening the door 13. Using a door 13 which encompasses approximately one-half of the body's diameter (i.e., about 180°) optimizes the size of the paper roll 40 which can be inserted through the door. In such cases, the paper 40 would be inserted from the top or the bottom as would the inscribing member 42. An inscribing member 42 having a spring-like member 55 would more easily be insertable from the bottom to avoid snagging the inner core of the paper roll 40. Additionally, a small sized door 13 limits the size of the paper roll while a wider door 13 adversely affects the structural integrity of the body 11.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiment[s ]illustrated, but by the appended claims and their legal equivalents.

The invention claimed is:

1. A writing implement comprising:

a. an elongated body having a first end and a second end;

b. one or more end members removably connectable to said elongated body;

c. an inscribing member within said elongated body, said inscribing member being exposable from an end of said elongated body;

d. a door on said elongated body, said door having a hinge edge movably attached to said elongated body and an opening edge on said door opposite from said hinge edge which, when said door is opened, exposes a chamber within said elongated body and an outer edge on said elongated body; and e. a roll of paper removably housable in said chamber and rollably held in place thereat by said inscribing member whereby as paper is needed, said door is opened, said paper is unrolled in a desired quantity, said door is closed, and the paper so removed from said chamber being tearable at said opening edge.

2. The implement as defined in claim 1 wherein said door and said elongated body further comprises a retaining means for retaining said door in a closed position.

3. The implement as defined in claim 2 wherein said retaining means comprises one or more detents and corresponding receptacles on said door and on said elongated body.

4. The implement as defined in claim 1 wherein said door further comprises a means for facilitating the opening of said door.

5. The implement as defined in claim 4 wherein said means for facilitating opening of said door comprises a slot on said door.

6. The implement as defined in claim 4 wherein said means for facilitating opening of said door comprises an indent on an-outer surface of said door.

7. The implement as defined in claim 1 wherein said opening edge of said door is serrated.

8. The implement as defined in claim 1 wherein said outer edge of said body is serrated.

9. The implement as defined in claim 1 wherein said end member is at one end of said elongated body.

10. The implement as defined in claim 9 wherein said end member is in threaded communication with said elongated body.

11. The implement as defined in claim 9 wherein said end member is friction-fitted to and from said elongated body.

12. The implement as defined in claim 1 wherein said one or more end members are in threaded communication with said elongated body.

13. The implement as defined in claim 1 wherein said one or more end members are friction-fitted to and from said elongated body.

* * * * *